United States Patent [19]

Skardal

[11] 4,224,145

[45] * Sep. 23, 1980

[54] VORTEX CLEANER

[75] Inventor: Karl A. Skardal, Bergstigen, Sweden

[73] Assignee: Cellwood Grubbens AB, Stockholm, Sweden

[ * ] Notice: The portion of the term of this patent subsequent to May 29, 1996, has been disclaimed.

[21] Appl. No.: 963,356

[22] Filed: Nov. 24, 1978

[30] Foreign Application Priority Data

Dec. 2, 1977 [SE] Sweden ..... 7713730
Nov. 7, 1978 [SE] Sweden ..... 7811510

[51] Int. Cl.[2] ..... B04C 5/16
[52] U.S. Cl. ..... 209/211; 210/512 R
[58] Field of Search ..... 209/144, 158, 211; 55/459; 210/512 R, 512 M

[56] References Cited

U.S. PATENT DOCUMENTS 3,800,946 4/1974 Reid et al. ..... 55/191

FOREIGN PATENT DOCUMENTS 187435 1/1964 Sweden .

OTHER PUBLICATIONS

U.S. Ser. No. 860,105 filed 12-13-77 to Skardal.

*Primary Examiner*—William A. Cuchlinski, Jr.
*Attorney, Agent, or Firm*—Haseltine, Lake & Waters

[57] ABSTRACT

A vortex cleaner for separating fibrous suspensions into fractions, in particular for cleaning papermaking pulp suspensions from impurities as chips, shives, sand grains, metal particles, etc., comprises an elongate vortex chamber, which has a circular cross-section and which over part of its length tapers towards its one axial end. The larger end of this vortex chamber has at least one tangential inlet for the suspension to be treated and an axial accept outlet for a lighter fraction of the treated suspension. The smaller end of the vortex chamber has an axial reject outlet for a heavier fraction of the treated suspension. The tapering part of the vortex chamber has a boundary wall which consists of one or preferably two ledges, which face the larger end of the vortex chamber and extend helically with diminishing diameter towards the smaller end of the vortex chamber, and a sidewall interconnecting the consecutive convolutions of said ledge or ledges. This sidewall is inclined relative to the axis of the vortex chamber so as to be conically divergent towards the smaller end of the vortex chamber.

8 Claims, 3 Drawing Figures

VORTEX CLEANER

Figure 1:
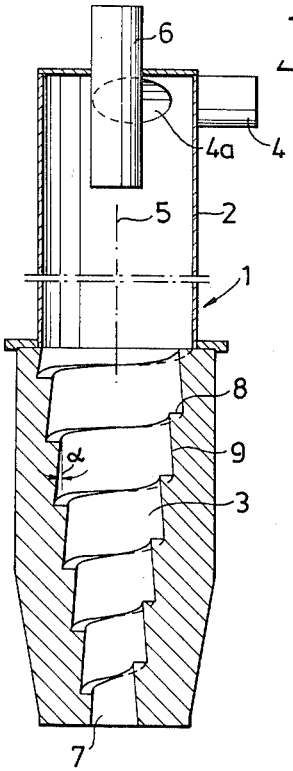

The present invention relates to a vortex cleaner, also often called hydrocyclone, for separating a fibre-liquid-suspension, in particular an aqueous suspension of papermaking pulp, into fractions, which cleaner is of the well-known basic type comprising an elongate vortex chamber, which has a circular cross-section and tapers gradually over part of its length towards one axial end of the chamber, the larger end of this vortex chamber being provided with at least one substantially tangential inlet for the suspension to be treated and a first, axial outlet for a lighter fraction of the treated suspension and the smaller end of the vortex chamber being provided with a second, axial outlet for a heavier fraction of the treated suspension.

Vortex cleaners of this type are used in large numbers in the paper and pulp industry for cleaning pulp suspensions from impurities such as chips, shives, sand grains, metal particles and also larger metal objects as for instance paper clips, paper staples, needles, bolts, nuts etc, which latter impurities are often present in pulp suspensions prepared from waste paper.

A vortex cleaner of this type operates fundamentally in the following manner. The suspension to be treated, the so-called inject, is fed into the vortex chamber at a high velocity through the tangential inlet at the larger end of the chamber. The suspension is fed into the chamber close to the inside of the wall of the chamber and will form a helical vortex flow which moves along the inside of the wall towards the opposite, tapering end of the chamber. Under the influence of the centrifugal forces in this vortex flow the particles in the suspension tend to arrange themselves in such a manner that heavier and larger particles, as for instance impurities in the form of chips, shives, sand grains, metal particles, metal objects etc., collect as close as possible towards the wall of the vortex chamber, whereas lighter particles in the suspension, i.e. the usable fibres when a pulp suspension is being cleaned, remain closer to the center axis of the vortex chamber. At the tapering end of the vortex chamber the layer of the vortex flow closest to the wall of the chamber, which layer contains the accumulated heavier impurities, will continue to move towards the axial outlet at the smaller end of the vortex chamber so as to be discharged through this outlet as a heavier fraction of impurities, the so-called reject. The inner portion of the vortex flow, on the other hand, reverses adjacent the tapering end of the chamber and continues in the axially opposite direction as an inner helical vortex flow, which is withdrawn through the axial outlet at the larger end of the chamber as a lighter fraction, the so-called accept, which consists for its major part of usable fibres when a pulp suspension is being cleaned.

Vortex cleaners of this type as previously used for the cleaning of papermaking pulp suspensions have a vortex chamber with a tapering portion shaped as a truncated cone with a smooth inner wall. However, in these prior art vortex cleaners it has been found that the suspension layer containing larger and heavier impurities, which accumulates close to the wall of the conically tapering part of the vortex chamber, will in many cases not manage to move all the way to the smaller end of the vortex chamber so as to be discharged through the reject outlet in the intended manner. This results in an increasing accumulation of impurities in the conical tapering part of the vortex chamber, whereby the cleaner may finally become completely clogged, in which case the operation of the cleaner must be interrupted so that the clogged reject outlet can be cleared. Even if such a complete clogging of the vortex cleaner does not arise, if often occurs that larger impurities of hard material present in the suspension, as for instance stones and metal objects, remain in the conically tapering portion of the vortex chamber for a considerable time, during which they are rotated continuously by the vortex flow in the peripheral direction close to the conical wall of the vortex chamber and substantially at one and the same place, which will in a short time give cause to very serious wear damages on the wall of the chamber.

A fundamental reason for the above phenomenon in prior art vortex cleaners seems to be that the conical wall of the vortex chamber exerts a reaction force on the suspension layer closest to the wall, which reaction force is substantially perpendicular to the wall and as a consequence has an axial component directed towards the larger end of the vortex chamber. This axial force component will counteract and may balance the force produced by the inject feed pressure, which strives to move the vortex flow towards the smaller end of the vortex chamber. It will be appreciated that it is the radial contraction of the vortex flow, caused by the conically tapering portion of the vortex chamber, which causes the portion of the vortex flow closest to the center axis of the vortex chamber to reverse and move in the axial opposite direction towards the accept outlet at the larger end of the chamber. If, however, the two above-mentioned forces acting upon the suspension layer closest to the conical wall of the vortex chamber happen to balance each other, it is realized that the impurities concentrated in this suspension layer will find it very difficult to move in the intended manner towards the reject outlet at the smaller end of the vortex chamber. In vortex cleaners used for cleaning papermaking pulp suspensions it has been found that this problem becomes the more difficult the higher the consistency of the treated pulp suspension is. When preparing papermaking pulp it is a very substantial advantage, however, to be able to work with pulp suspensions with a high consistency, for instance 1% or higher, as this reduces the size and thus the investment costs for all apparatuses in the plant, as pipes, pumps, cleaners, etc., and also reduces the need of thickeners, and above all reduces considerably the operating costs for the pulp cleaning plant, as much smaller volumes of pulp suspension have to be circulated and pumped through the plant.

For reducing this problem it has been proposed, in U.S. Pat. No. 3,800,946, to provide the wall of the conically tapering part of the vortex chamber with one or several screw-thread-like spiral grooves each having a substantially rectangular or trapezoidal cross-section and extending either in the opposite or the same direction as the direction of rotation of the suspension vortex in the vortex chamber. As, however, in this proposed arrangement the top wall as well as the bottom wall of the screw-thread are still inclined relative to the center axis of the vortex chamber so as to be conically diverging towards the larger end of the vortex chamber, the above-discussed problem remains substantially uneffected, namely that the suspension layer closest to the wall of the vortex chamber is subjected to reaction forces from the chamber wall counteracting the transport of the suspension towards the reject outlet at the smaller end of the chamber. The thread groove may certainly, at least when it extends in the same direction as the direction of rotation of the suspension vortex, assist in the transport towards the reject outlet of the portion of the suspension located within the thread groove itself. As, however, the thread grooves are very shallow, the depth being only about 1.5mm, this effect will in the practice be extremely small. A substantial increase of the depth of the thread grooves would, on the other hand, probably give cause to serious disturbances in the inner portion of the vortex flow, which portion will reverse in the conical tapering part of the vortex chamber and return towards the larger end of the vortex chamber.

In Swedish Pat. No. 187,435 it has been proposed in connection with a cyclone separator of the general type described in the foregoing used for cleaning a gas from dust and other solid particles, to remedy a problem similar to the one discussed in the foregoing by providing the wall of the tapering portion of the vortex chamber with a ledge extending helically as a screw-thread with diminishing diameter towards the smaller end of the chamber with the same direction of rotation about the axis of the chamber as the direction of rotation of the gas flow in the chamber, and in that the wall interconnecting the consecutive convolutions of this helically extending ledge is parallel to the axis of the vortex chamber so that this wall cannot exert any axially directed reaction force upon the gas-dust-layer closest to the wall. When testing a similar design of a vortex cleaner for papermaking pulp suspensions, it has been found, however, that actually a much inferior result is obtained than with a conventional vortex cleaner, in which the tapering portion of the vortex chamber has a completely smooth, truncated conical wall. This result is somewhat surprising and difficult to explain. The reason may be that the helically extending ledge itself causes an axial reaction force component which is directed towards the larger end of the vortex chamber and which counteracts and disturbs an orderly movement of the heavier fraction towards the reject outlet at the smaller end of the vortex chamber. In any case, these test results cannot encourage a person skilled in the art to try to use a design according to Swedish Pat. No. 187,435 for a vortex cleaner to be used for cleaning papermaking pulp suspensions.

Very surprisingly it has been found, however, and the present invention is founded on this unexpected discovery, that strikingly improved results can be achieved with a vortex cleaner of the general type described in the foregoing when cleaning fibre-liquid-suspensions, in particular aqueous suspensions of papermaking pulp, if the tapering portion of the vortex chamber is provided with at least one ledge facing the larger end of the chamber and extending helically with diminishing diameter towards the smaller end of the chamber with the same direction of rotation about the axis of the chamber as the direction of rotation of the vortex flow, in principle much in the same way as suggested in Swedish Pat. No. 187,435, but with the very important difference that the sidewall of the vortex chamber interconnecting the consecutive convolutions of said ledge is inclined relative to the axis of the vortex chamber in such a way that this sidewall is conically diverging in direction towards the smaller end of the vortex chamber.

It has been found that this seemingly insignificant modification actually results in a vortex chamber having substantially improved operation efficiency and results, not only when compared with a vortex chamber in which said sidewall is parallel to the axis of the vortex chamber in the manner proposed in Swedish Pat. No. 187,435 but also when compared with a conventional vortex chamber in which the tapering part of the chamber has a completely smooth, truncated conical wall, which is the design previously and presently used for vortex cleaners for the cleaning of papermaking pulp suspensions.

It has been found particularly favorable, if the angle of inclination of said sidewall relative to the axis of the vortex chamber lies within the range up to 5° and in particular within the range from 1° to 4°.

The number of helically extending ledges can vary. If two or more helically extending ledges are used, these are disposed relative each other in a manner similar to the thread grooves in a screw-thread having several entries or starts. Particularly favorable results have been obtained when testing a vortex cleaner provided with two helically extending ledges.

The pitch of each helically extending ledge, independent of whether one or several ledges are provided, is preferably of the same magnitude as the axial dimension of the entrance opening of the tangential inject inlet to the vortex chamber.

Figure 2:
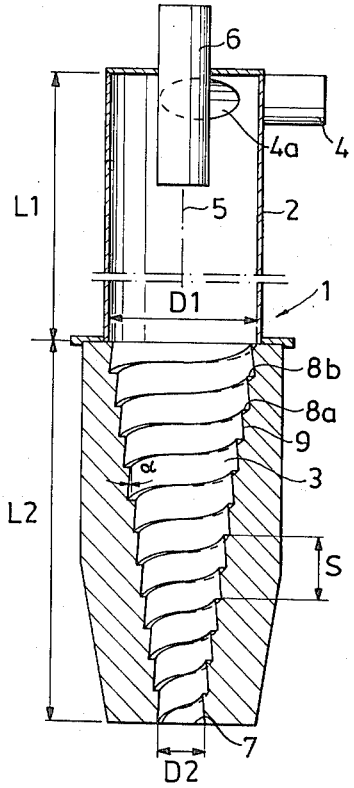
Figure 3:
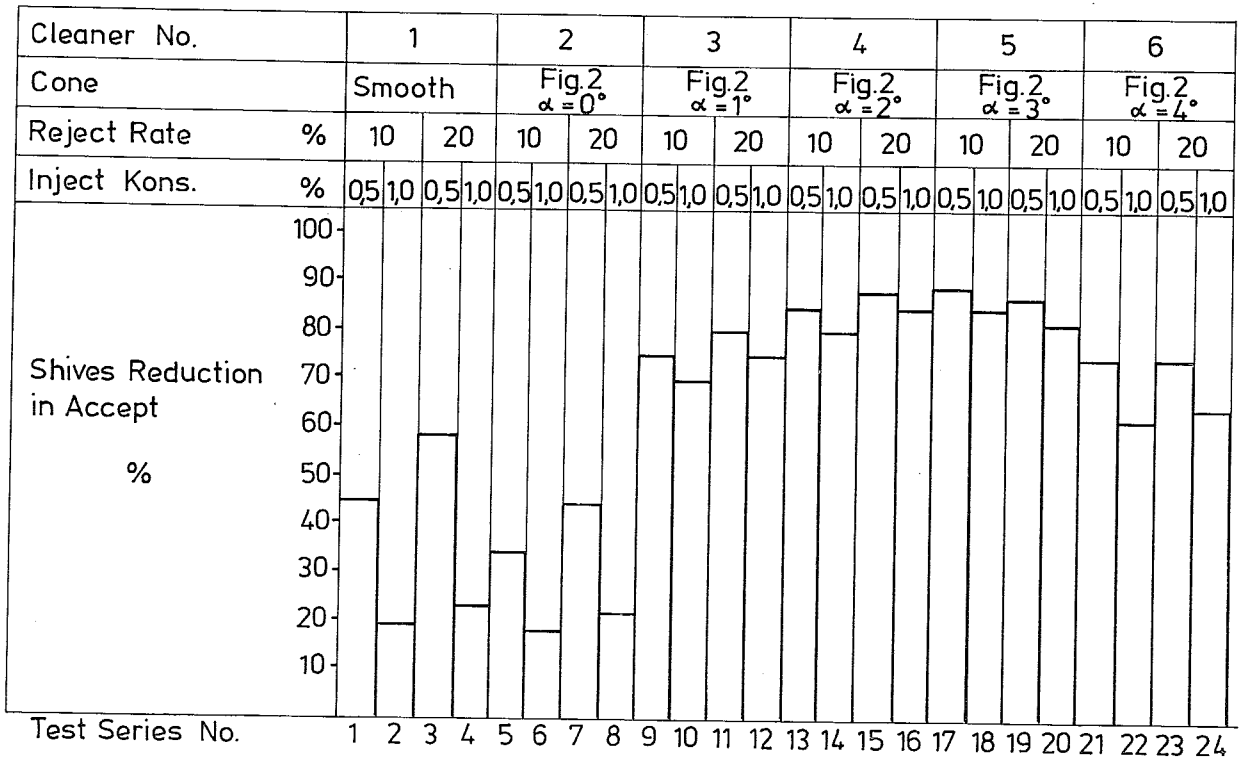

The invention and additional characteristical features thereof will be described in greater detail in the following with reference being made to the accompanying drawings, wherein:

FIG. 1 shows, by way of example, schematically and in axial section a vortex cleaner according to the invention, in which the tapering part of the vortex chamber is provided with one helically extending ledge;

FIG. 2 is a view, similar to the one in FIG. 1, of a vortex cleaner according to the invention, in which the tapering part of the vortex chamber is provided with two, helically extending ledges; and FIG. 3 is a bar-chart illustrating the results from a large number of comparison tests made on a number of vortex cleaners according to the invention having different angles of inclination for the sidewall interconnecting consecutive convolutions of the helically extending ledge, on a vortex cleaner designed along the principle disclosed in Swedish Pat. No. 187,435 so that said sidewall is parallel to the axis of the vortex chamber, and on a conventional vortex cleaner having a smooth, truncated conical wall in the tapering part of the vortex chamber.

The vortex cleaners according to the invention shown schematically and by way of example in FIGS. 1 and 2 comprise in a conventional manner an elongate vortex chamber, which is generally designated with 1 and which comprises a circular cylindrical portion 2 and a portion generally designated with 3, which tapers towards one axial end of the vortex chamber. In vortex cleaners previously and presently used for the cleaning of papermaking pulp suspensions, this tapering portion of the vortex chamber is shaped as a truncated cone with a smooth conical inner wall surface. At its larger end the vortex chamber 1 is provided with a tangential inlet 4 for the suspension to be treated and also with an axial accept outlet 6, disposed centrally relative to the axis 5 of the vortex chamber, for a lighter fraction of the treated suspension. At its smaller end the vortex chamber is provided with a similar, axial reject outlet 7 for a heavier fraction of the treated suspension. This reject outlet can in conventional manner be connected to a suitable, conventional reject discharge device (not shown in the drawing) for controlling the rate of the reject flow.

When a suspension is injected with high velocity through the inject inlet 4 in tangential direction close to the inside of the wall of the vortex chamber 1, the suspenison will form a helical vortex flow which moves towards the tapering end of the chamber. Under the influence of the centrifugal forces in this vortex flow, the particles in the suspension strive to arrange themselves in such a way that heavier particles are concentrated to a layer close to the inside of the wall, and this layer will be moved by the vortex flow towards the smaller end of the vortex chamber to be discharged through the reject outlet 7. Due to the tapering form of the vortex chamber, the major portion of the vortex flow will reverse its direction within this tapering part of the vortex chamber and continue in the opposite direction towards the larger end of the vortex chamber as an inner helical vortex flow. This inner vortex flow, which in the ideal case shall be substantially free from larger and heavier particles, i.e. from impurities, is discharged through the axial accept outlet 6, which in the illustrated embodiment of the invention is designed in a well-known manner as a vortex finder tube projecting axially into the vortex chamber.

In a conventional vortex cleaner of this type, in which the tapering part of the vortex chamber is shaped as a truncated cone with a smooth wall, it can occur, as mentioned in the foregoing, that the suspension layer closest to the wall of the vortex chamber, in which layer the heavier and larger particles have accumulated, does not manage to move along the conical wall all the way to the reject outlet 7, but will instead to a substantial extent remain within the conical part of the vortex chamber. In the vortex cleaner according to the invention this serious deficiency is eliminated due to a novel and specific design of the tapering part 3 of the vortex chamber.

According to the invention, the boundary wall of the tapering part 3 of the vortex chamber is provided, as illustrated in FIG. 1, with at least one ledge 8 which extends helically with diminishing diameter towards the smaller end of the vortex chamber and with a direction of rotation about the axis 5 of the chamber corresponding to the flow direction of the suspension injected through the tangential inject inlet 4 and thus to the direction of rotation of the outer vortex flow closest to the wall of the vortex chamber. The sidewall 9, which interconnects consecutive convolutions of the ledge 8, is according to the invention inclined by an angle $\alpha$ relative to the axis 5 of the vortex chamber in such a way that this sidewall 9 can be described as conically diverging towards the reject outlet 7. It will be appreciated that this sidewall 9 will exert a reaction force on the portion of the suspension closest to the wall with an axial component directed towards the smaller end of the vortex chamber, whereby this sidewall 9 will, in contrast to the situation in a conventional vortex cleaner, assist in the transport of the portion of the suspension closest to the wall in direction towards the reject outlet 7 in the desired way. The inclination of the sidewall 9 relative to the axis 5 of the vortex chamber can vary depending on the intended use of the vortex chamber, i.e. the properties of the suspension to be treated, and other operating conditions of the cleaner. The angle of inclination $\alpha$ can lie in the range up to 10° and lies preferably in the range up to 5°. When testing a vortex cleaner for the cleaning of pulp suspension, very satisfactory results have been obtained with an inclination angle in the range from 1° to 4°.

As the helically extending ledge 8 is facing the larger end of the vortex chamber, this ledge will of course exert upon the portion of the suspension immediately above the ledge a reaction force having an axial component directed towards the larger end of the vortex chamber. This effect is, however, counteracted and overcome by the oppositely directed axial component of the reaction force which the inclined sidewall 9 exerts upon the suspension layer closest to this sidewall. In this connection it should be noticed that the sidewall 9 can act upon a larger volume of the suspension than the narrow ledge 8.

The pitch of the helically extending ledge 8 is not particularly critical. By "pitch" is meant the distance between one point on the helically extending ledge and the corresponding point on an adjacent convolution of the ledge. However, it is preferable to choose the pitch to be of the same magnitude as the axial height of the entrance opening 4*a* of the tangential inject inlet 4 to the vortex chamber, as it is the axial height of this inlet opening 4*a* which determines primarily the "height" of the inlet flow which continues as a helical vortex flow downwards through the vortex chamber.

The width of the ledge 8 will be determined by said pitch of the ledge, the inclination of the sidewall 9 relative to the axis 5 of the vortex chamber and by the rate with which the part 3 of the vortex chamber tapers from the diameter of the circular cylindrical part 2 to the diameter of the reject outlet 7. It will be appreciated that the helical inner edge of the ledge 8 is located on an imaginary, truncated conical surface having a cone angle relative to the axis 5 of the vortex chamber which determines the rate with which the part 3 of the chamber tapers towards the reject outlet 7. The apex angle of said imaginary, truncated conical surface may be of substantially the same magnitude as the corresponding apex angle of the conical surface wall of prior art vortex cleaners, i.e. for instance within the range from 8° to 30°.

In the illustrated embodiment of the invention the ledge 8 is perpendicular to the axis 5 of the vortex chamber, as seen in an axial section. However, there is nothing to prevent the ledge from being somewhat inclined, as seen in axial section, downwards towards the reject outlet 7. On the other hand, the ledge 8 should not be inclined in the opposite direction, i.e. upwards towards the accept outlet 6.

The width of the ledge 8 may preferably be constant over the entire length of the ledge. However, the width of the ledge may also vary, for instance in such a way that the ledge becomes narrower closer to the reject outlet 7. This may be the case, if the pitch of the ledge is constant, but the tapering part 3 of the vortex chamber tapers more quickly closer to the cylindrical part 2 of the chamber and more slowly adjacent the reject outlet 7.

In the embodiment of the invention illustrated in FIG. 1 and described in the foregoing, the tapering part 3 of the vortex chamber is provided with only a single, helically extending ledge 8. As mentioned in the foregoing, however, there is nothing to prevent a vortex cleaner according to the invention having a tapering part of the vortex chamber provided with several, helically extending ledges, for instance as the vortex cleaner according to the invention illustrated in FIG. 2, which has two, helically extending ledges 8*a* and 8*b*, which are arranged relative each other in a manner similar to the thread-grooves in a screw-thread with two entries. Each ledge 8a and 8b, respectively, has in this case preferably substantially the same pitch as the single ledge 8 in the embodiment according to FIG. 1 and will consequently have only one half of the width of the single ledge 8. When testing vortex cleaners according to the invention for cleaning pulp suspensions it was found that a design according to FIG. 2 with two, helically extending ledges 8a, 8b gave better results than a design according to FIG. 1 with only a single, helically extending ledge 8. One reason for this may be that in a vortex cleaner according to FIG. 1 the "transport" of the suspension towards the reject outlet will be larger than the desired discharge rate through the reject outlet from the vortex chamber. As mentioned in the foregoing, the ledge 8 in the embodiment according to FIG. 1 will also be wider than the ledges 8a and 8b in the embodiment according to FIG. 2 and this might give cause to an unfavourable disturbance of the flow pattern within the tapering part 3 of the vortex chamber in the embodiment illustrated in FIG. 1.

For comparing vortex cleaners according to the invention with vortex cleaners of a conventional design as well as with vortex cleaners designed according to the principle proposed in the Swedish Pat. No. 187,435, a large number of field tests were made on four different vortex cleaners, called cleaners Nos. 3, 4, 5, and 6 respectively, designed according to the invention in the manner illustrated in FIG. 2, i.e. with two helically extending ledges 8a and 8b, and with an angle of inclination $\alpha$ for the sidewall 9 of 1°, 2°, 3+, and 4° respectively; further on a vortex cleaner, called cleaner No. 2, designed in the manner illustrated in FIG. 2 but with the sidewall 9 parallel to the axis 5 of the vortex chamber, i.e. with the angle $\alpha=0°$, which corresponds to a design according to Swedish Pat. No. 187,435; and finally also on a conventional vortex cleaner, called cleaner No. 1, in which the tapering part of the vortex chamber has a completely smooth, truncated conical wall. All tested vortex cleaners had the following dimensions, with reference to FIG. 2:

$L_1=450$ mm
$L_2=450$ mm
$D_1=125$ mm
$D_2=30$ mm
$S=40$ mm (excluding cleaner No. 1, which had a smooth conical wall)

For each vortex cleaner four test series were made on papermaking pulp suspensions with two different values 0.5% and 1.0% respectively, for the consistency of the inject suspension and also two different values for the reject output rate, namely 10% and 20% respectively, of the inject rate. The inject rate was 300 l/min for all tests. Thus, this field testing comprised in total 24 test series. Each of these test series comprised several different test runs on fully bleached sulphite pulp as well as thermo-mechanical pulp and for each such test series one determined the average value for the shives reduction in the accept expressed in percent, i.e. the reduction of the amount of shives in the accept as compared to the amount of shives in the inject.

The results from these field tests are shown in the bar-chart in FIG. 3, where each bar indicates the average value of the shives reduction for the test series concerned.

As can be seen in the chart, the test series Nos. 1 to 4 were made with the conventional vortex cleaner No. 1 having a completely smooth, truncated conical wall; whereas the test series Nos. 5 to 8 were made with the vortex cleaner No. 2 with a design in principle according to FIG. 2 but with the angle $\alpha=0°$, i.e. with the sidewall 9 parallel to the axis 5 of the vortex chamber; and finally the test series Nos. 9–12, Nos. 13–16, Nos. 17–20, and Nos. 21–24 were made with the four vortex cleaners Nos. 3, 4, 5, and 6 according to the invention designed according to FIG. 2 with the inclination angle $\alpha$ of the sidewall 9 equal to 1°, 2°, 3+, and 4° respectively.

The test results show that the conventional cleaner No. 1 provided such a low shives reduction for an inject consistency of 1.0% that it is not possible in the practice to operate this conventional vortex cleaner with such a high inject consistency. Thus, this conventional cleaner can only be operated with a comparatively low inject consistency, for instance 0.5%, and preferably with a comparatively high reject rate, for instance 20%, if an acceptable shives reduction is to be obtained.

As the chart shows, the cleaner No. 2 ($\alpha=0°$) gave a still more inferior result, in particular for an inject consistency of 0.5%, wherefore a vortex cleaner of this design is in practice unusable for the cleaning of papermaking pulp suspensions.

The four cleaners Nos. 3, 4, 5, and 6 according to the invention gave, on the other hand, exceedingly good results, as can be seen from the chart. In particular, this is true for the cleaners Nos. 3, 4, and 5 having an inclination angle $\alpha$ of 1°, 2°, and 3°, respectively. Most noteworthy is the very high shives reduction in the accept, which is obtained also with a high inject consistency of 1.0% and a low reject rate of 10%. It will be appreciated that for the economy of a pulp cleaning plant, with regard to the capital costs as well as the operation costs, it is of primary importance that a high shives reduction in the accept can be obtained with a high consistency of the inject suspension and a small reject rate. In the chart, one may for instance compare the test series No. 18, in which a vortex cleaner according to the invention gave an average shives reduction in the accept of 84% with an inject consistency of 1.0% and a reject rate of 10%, with the test series No. 3, at which a conventional vortex cleaner gave a shives reduction in the accept of only 58% with an inject consistency of only 0.5% and a reject rate as high as 20%. It can be shown that a pulp cleaning plant corresponding to the test series No. 3 will require at least twice the capital costs and have 4 to 5 times higher operating costs than a cleaning plant corresponding to the test series no. 18.

I claim:

1. A vortex cleaner for separating a fibre-liquid-suspension, in particular an aqueous suspension of papermaking pulp, into fractions, comprising an elongate vortex chamber, which has a circular cross-section and which over part of its length tapers towards one axial end of the chamber, said chamber having at its larger end a substantially tangential inlet for the suspension to be treated and a first, axial outlet for a lighter fraction of the treated suspension and at its smaller end a second, axial outlet for a heavier fraction of the treated suspension, the boundary wall surrounding said tapering part of the vortex chamber having at least one ledge, which faces the larger end of the vortex chamber and extends helically with a diminishing diameter towards the smaller end of the vortex chamber with a direction of rotation about the axis of the vortex chamber corresponding to the flow direction of a suspension flow injected through said tangential inlet, and a sidewall interconnecting the consecutive convolutions of said ledge, said sidewall being inclined relative to the axis of the vortex chamber so as to be conically divergent towards the smaller end of the chamber.

2. A vortex cleaner as claimed in claim 1, wherein the angle of inclination of said sidewall relative to the axis of the vortex chamber lies within the range up to 5°

3. A vortex cleaner as claimed in claim 2, wherein said angle of inclination lies within the range from 1° to 4°.

4. A vortex cleaner as claimed in claim 1, wherein the pitch of said helically extending ledge is of the same magnitude as the axial dimension of the entrance opening of said tangential inlet to the vortex chamber.

5. A vortex cleaner as claimed in claim 1, wherein said ledge is substantially perpendicular to the axis of the vortex chamber, as seen in an axial section.

6. A vortex cleaner as claimed in claim 1, wherein said ledge is somewhat inclined towards the smaller end of the vortex chamber, as seen in an axial section.

7. A vortex cleaner as claimed in claim 1, wherein said ledge has a substantially constant width over its entire length.

8. A vortex cleaner as claimed in claim 1, wherein the boundary wall surrounding the tapering part of the vortex chamber at least two helically extending ledges of the kind defined, said ledges being disposed relative to each other in a manner similar to the thread grooves of a screw-thread with several entries.

* * * * *